US006653606B1

(12) United States Patent
Son et al.

(10) Patent No.: US 6,653,606 B1
(45) Date of Patent: Nov. 25, 2003

(54) AUTOMATIC CONDENSATION PREVENTION/REMOVAL SYSTEM

(76) Inventors: Jae S. Son, 6452 Ocean Crest Dr., Apt. D101, Rancho Paolo Verdes, CA (US) 90275; Benny Sin, 231 S. Bayview Ave., #15, Sunnyvale, CA (US) 94086

( * ) Notice: Subject to any disclaimer, the term of this patent is extended or adjusted under 35 U.S.C. 154(b) by 22 days.

(21) Appl. No.: 10/018,694

(22) PCT Filed: May 31, 2000

(86) PCT No.: PCT/US00/14891

§ 371 (c)(1),
(2), (4) Date: Mar. 12, 2002

(87) PCT Pub. No.: WO00/76274

PCT Pub. Date: Dec. 14, 2000

Related U.S. Application Data

(60) Provisional application No. 60/137,279, filed on Jun. 3, 1999.

(51) Int. Cl.[7] ..... H05B 3/06

(52) U.S. Cl. ..... 219/522; 219/490; 219/203; 219/219

(58) Field of Search ..... 219/522, 490, 219/203, 209, 211, 212, 213, 217, 218, 219, 501; 340/601, 602

(56) References Cited

U.S. PATENT DOCUMENTS

| | | | | | |
|---|---|---|---|---|---|
| 3,934,111 | A | * | 1/1976 | Roselli et al. | 219/203 |
| 3,968,342 | A | | 7/1976 | Inaba | |
| 4,032,745 | A | * | 6/1977 | Roselli | 219/203 |
| 4,439,666 | A | * | 3/1984 | Graham | 219/213 |
| 4,506,137 | A | | 3/1985 | Meister | |
| 4,568,281 | A | | 2/1986 | Harvey et al. | |
| 4,581,522 | A | * | 4/1986 | Graham | 219/213 |
| 4,870,252 | A | * | 9/1989 | Balmer | 219/501 |
| 5,378,874 | A | * | 1/1995 | Holling et al. | 219/501 |
| 5,710,408 | A | * | 1/1998 | Jones | 219/213 |
| 5,763,858 | A | * | 6/1998 | Jones | 219/213 |

FOREIGN PATENT DOCUMENTS

GB 1 420 150 1/1976

OTHER PUBLICATIONS

International Search Report from International Application No. PCT/US00/14891.

* cited by examiner

*Primary Examiner*—Teresa Walberg
*Assistant Examiner*—Fadi H. Dahbour
(74) *Attorney, Agent, or Firm*—Wolf, Greenfield & Sacks, P.C.

(57) ABSTRACT

A condensation control system to remove or prevent condensation on a surface, such as a mirror. The condensation control system has a first terminal that is adapted to be directly connected to an AC power source and a second terminal. In one embodiment, the condensation control system includes a heating element, a power regulation device having a trigger, a voltage divider having an output, and a humidity sensor. The heating element is electrically coupled in series with the power regulation device between the first and second terminals. The voltage divider is electrically coupled in series between the first and second terninals and in parallel with the heating element and the power regulation device. The humidity sensor is electrically coupled between the output of the voltage divider and the trigger of the power regulation device. The humidity sensor senses an amount of humidity and triggers the power regulation device to activate the heating element when the amount of humidity sensed by the humidity sensor is greater than a predetermined humidity threshold set point.

20 Claims, 3 Drawing Sheets

AUTOMATIC CONDENSATION PREVENTION/REMOVAL SYSTEM

This application claims the benefit of provisional application Ser. No. 60/137,279 filed Jun. 3, 1999.

FIELD OF THE INVENTION

The present invention relates to preventing and/or removing condensation from smooth surfaces, and more particularly, to a system for automatically preventing and/or removing condensation from at least a portion of a glass or mirrored surface.

DESCRIPTION OF THE RELATED ART

Many people are familiar with the problems associated with using a bathroom mirror shortly after taking a shower or bath, or while the shower or bath is otherwise on. The moisture in the air from the hot water of the shower or bath condenses on the mirror surface and impairs visibility. Although many residential bathrooms have an exhaust fan that accelerates the removal of moisture from the bathroom, most bathroom fans require an appreciable amount of time before condensation on the mirror surface is dissipated.

U.S. Pat. No. 4,956,542 to Prosser discloses a mirror defogger assembly that uses a heating element to prevent condensation from forming on the surface of a mirror. The mirror defogger assembly includes a humidistat, a control module/transformer, and a heating element that is attached to the surface of the mirror. The humidistat sends an electronic signal to the control module/transformer when the humidity level reaches a predetermined point. The electronic signal, when received by the control module/transformer, activates the heating element, thereby warning the mirror surface and preventing condensation. Although mirror defogging systems that incorporate a heating element are known in the art, such systems are limited due to cost, reliability, as well as a number of other factors. For example, in the mirror defogger assembly of Prosser, the use of a transformer to convert household AC power to a level suitable for use with the heating element adds both cost and bulk to the assembly.

SUMMARY OF THE INVENTION

The present invention provides a reliable and inexpensive condensation prevention and/or removal system that can be attached to any surface upon which condensation may form. Advantageously, embodiments of the present invention can be directly connected to standard household wiring without the use of special power supplies or transformers. Moreover, embodiments of the present invention automatically turn on and off to control condensation formation based on the humidity of the ambient environment and without any user intervention. This automatic operation keeps the condensation prevention and/or removal system from being left in an on condition, thereby enhancing safety and reducing operating costs.

According to one embodiment of the present invention, a condensation control system is provided having a first terminal that is adapted to be directly connected to an AC power source and a second terminal. The condensation control system includes a heating element, a power regulation device having a trigger, a voltage divider having an output, and a humidity sensor. The heating element is electrically coupled in series with the power regulation device between the first and second terminals. The voltage divider is electrically coupled in series between the first and second terminals and in parallel with the heating element and the power regulation device. The humidity sensor is electrically coupled between the output of the voltage divider and the trigger of the power regulation device. The humidity sensor senses an amount of humidity and triggers the power regulation device to activate the heating element when the amount of humidity sensed by the humidity sensor is greater than a predetermined humidity threshold set point.

According to another embodiment of the present invention, a condensation control system is provided having a first terminal that is adapted to be directly connected to an AC power source and a second terminal. The condensation control system includes a heating element, a power regulation device having a trigger, first, second, and third resistors, and a humidity sensor. The heating element is electrically coupled in series with the power regulation device between the first and second terminals. The first resistor and the second resistor are electrically coupled in series between the first and second terminals and in parallel with the heating element and the power regulation device. The third resistor is electrically coupled between the trigger of the power regulation device and the second terminal. The humidity sensor is electrically coupled in series between the first resistor and the second resistor. The humidity sensor has a first terminal that is electrically coupled to the first resistor and a second terminal that is electrically coupled to the second resistor and the trigger of the power regulation device. The humidity sensor senses an amount of humidity and triggers the power regulation device to activate the heating element when the amount of humidity sensed by the humidity sensor is greater than a predetermined humidity threshold set point.

According to further aspects of the present invention, the power regulation device may include a triac, a thyristor, or other types of SCRs. Moreover, embodiments of the present invention may be used with different types of humidity sensors, such as variable resistance humidity sensors and variable capacitance humidity sensors, and may be used to activate the heating element to remove or prevent condensation over one half of an AC cycle, or over the full AC cycle.

BRIEF DESCRIPTION OF THE DRAWINGS

Illustrative, non-limiting embodiments of the present invention are described by way of example with reference to the accompanying drawings, in which.

DETAILED DESCRIPTION

Embodiments of the present invention will be understood more completely through the following detailed description which should be read in conjunction with the attached drawings in which similar reference numbers indicate similar structures.

Figure 1:
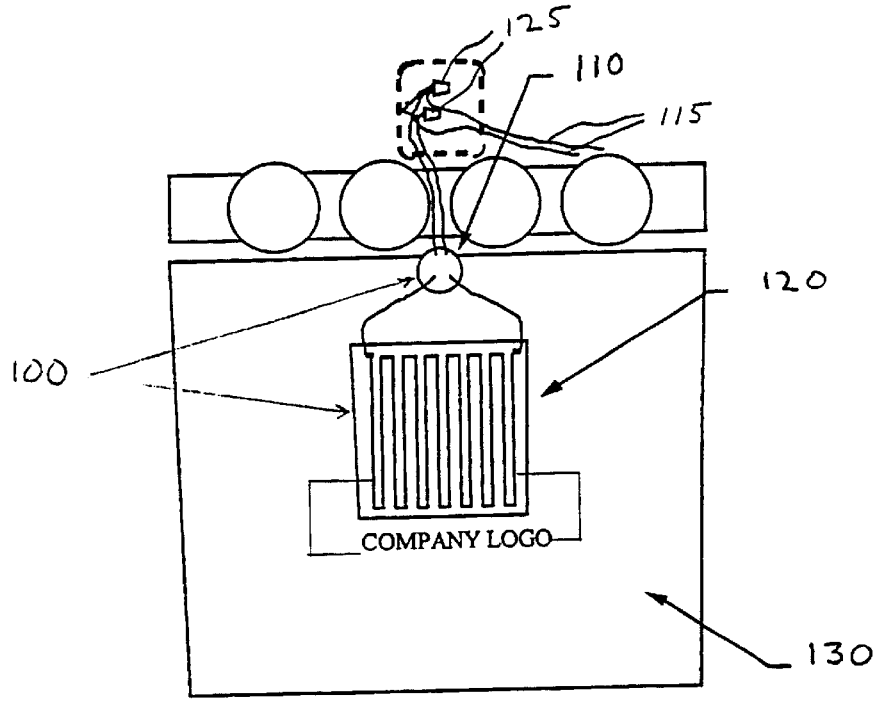
FIG. 1 is a plan view of a condensation prevention and/or removal system for a mirror according to one embodiment of the present invention.

FIG. 1 represents an illustrative implementation of a condensation prevention and/or removal system 100 that is attached to a surface of a mirror 130. As shown in FIG. 1, the condensation prevention and/or removal system 100 includes a controller 110 and a heating element 120. The entire system 100 (including the controller 110 and the heating element) can be attached to either the front surface or the rear surface of the mirror 130. Alternatively, controller 110 can be attached to the front surface of the mirror 130 and heating element 120 can be attached to the rear surface of the mirror 130, or vice versa. Preferably, the controller 110 is attached to the front surface of the mirror 130 so that changes in humidity are quickly detected, with the heating element 120 being attached to the rear surface of the mirror 130, to provide a clearer field of view. For increased aesthetic appeal, damage prevention, etc., the controller 110 may be covered by a small circular mirror, a decorative cover plate, etc.

As shown in FIG. 1, heating element 120 is disposed over a central portion of the mirror 130 in a serpentine manner. However, it should be appreciated that the heating element 120 can be disposed over a different portion of the mirror, or can be disposed over the entire surface of the mirror. Further, the geometry in which the heating element is disposed on the mirror may vary, depending on the shape of the mirror, as well as other factors. In one embodiment of the present invention, heating element 120 is disposed to form a company logo or to form letters, words, or numerals. For example, the heating element can be arranged in the shape of a hotel's corporate logo. It should also be appreciated that multiple systems 100 can be used, with a first being disposed to provide a clear viewing area, and the second to display a logo, etc. Alternatively, multiple heating elements can be used (e.g., one to provide a clear viewing area and another to display a logo) with only a single controller 110.

As shown in FIG. 1, the system 100 can be directly connected to standard electrical wiring 115 with the use of wire-nuts 125. Other types of electrical connectors such as crimp connectors, etc. may alternatively be used. To reduce the potential of injury, the system 100 may be connected to a circuit that is protected by a ground fault interruption type of circuit breaker or other type of protective circuit breaker. Advantageously, the system 100 can be connected to new or existing wiring without the use of a step-down transformer as discussed. in detail further below.

Figure 2:
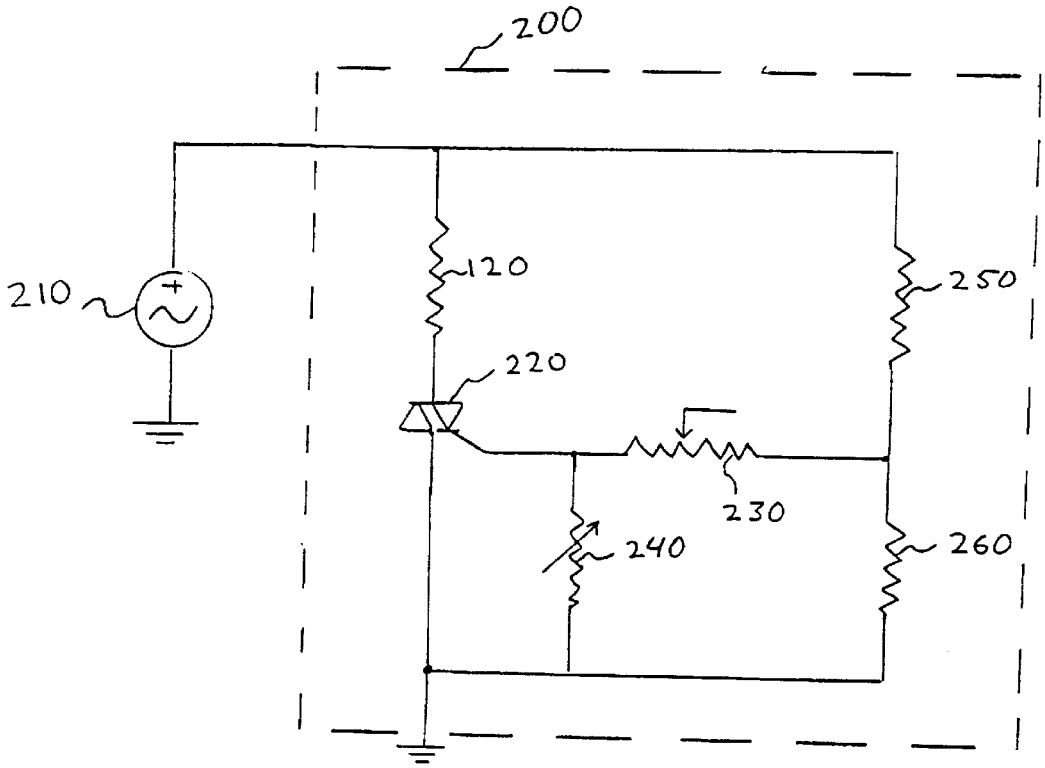
FIG. 2 is a schematic diagram of an exemplary implementation of a condensation prevention and/or removal system according to one embodiment of the present invention.

FIG. 2 is circuit schematic diagram of a condensation prevention and/or removal system according to one exemplary embodiment of the present invention. As shown the condensation prevention and/or removal system 200 includes a heating element 120, a power regulation device 220, a humidity sensor 230, a pair of fixed resistors 250, 260 that form a voltage divider, and a potentiometer or variable resistor 240. The system may be connected to a conventional source of power 210, such as an ordinary 120 volt or 220 volt AC power line. Advantageously, the condensation prevention and/or removal system 200 can be directly connected to a source of AC power 210 without the use of a transformer or specially designed power supply. This reduces the cost and bulk associated with the system 200, and reduces component count, thereby enhancing reliability.

In the embodiment of FIG. 2, the power regulation device 220 is depicted as a triac. However, it should be appreciated that other types of power regulation devices may alternatively be used, including SCR's, thyristors, etc. An advantage to the use of a triac in FIG. 2 is that it permits continuous operation during the full AC cycle without the use of additional components, such as a full wave rectifier.

Humidity sensor 230 is a variable resistance humidity sensor in which a resistance of the sensor 230 decreases with an increase in relative humidity. For example, in one embodiment of the present invention, a Scimarec HS15 humidity sensor is used, although other types of humidity sensors may alternatively be used, as the present invention is not limited to a particular type of humidity sensor. As the resistance of sensor 230 decreases, the amount of current provided to the trigger of the power regulation device 220 is increased above the triggering threshold of the power regulation device 220. The triggering of the power regulation device 220 permits current to flow through heating element 120, thereby increasing the temperature of the surface to which the heating element is attached to prevent or dissipate condensation.

The humidity threshold set point (i.e., the level of relative humidity at which the current provided to the trigger of the power regulation device 220 is sufficient to turn on the power regulation device 220) can be adjusted for different humidity environments by changing the value of resistance of potentiometer 240. For example, by increasing the resistance of potentiometer 240, the humidity threshold set point is increased, and by decreasing the resistance of potentiometer 240, the humidity threshold set point is decreased. Although not depicted in FIG. 1, potentiometer 240 can be disposed so that the potentiometer 240 is accessible to a user and can be adjusted by a user, should this be desired.

Preferably, the resistance of the heating element 120 is controlled so that the power density of the heating element 120 does not exceed 35 W/ft$^2$ (389 W/m$^2$). In a typical ambient environment, this value of power density allows the heating element 120 to ramp up rapidly in temperature to prevent or dissipate condensation, while remaining below a temperature of approximately 150° F. (66° C.). Empirical testing has demonstrated that by preventing the maximum temperature of the heating element 120 from rising above approximately 150° F. (66° C.), thermally induced stresses on the mirror 130 (in FIG. 1 ) are reduced, thereby lessening the potential for breakage or shattering. In addition, the risk of personal injury due to contact with the heated surface of the mirror 130 is reduced. For higher temperature ambient environments, a lower power density heating element can be used to prevent the heating element going beyond 150° F. (66° C.). Of course, it should be appreciated that the values listed herein are provided merely for illustrative purposes, as the present invention is not so limited.

It should be appreciated that the condensation prevention and/or removal system 200 of FIG. 2 automatically turns on the heating element 120 when the relative humidity level detected by the humidity sensor 230 rises above the predetermined threshold necessary to trigger the power regulation device 220. In addition, when the relative humidity level of the environment in which the system 200 is used falls below the predetermined threshold, such as when a bathroom door is opened, or when a bathroom fan finally removes a sufficient amount of the humid air, the condensation prevention and/or removal system 200 automatically shuts off the heating element 120. This helps to prevent the mirror from heating up to a high level. For additional safety, a thermally activated switch can be used (not shown) to shut off the heating element when it reaches a certain temperature, as known to those skilled in the art. In the event that the humidity of the environment in which the condensation prevention and/or removal system 200 is used never reaches the predetermined threshold of humidity, then the system remains in a standby state in which the heating element 120 is off.

Figure 3:
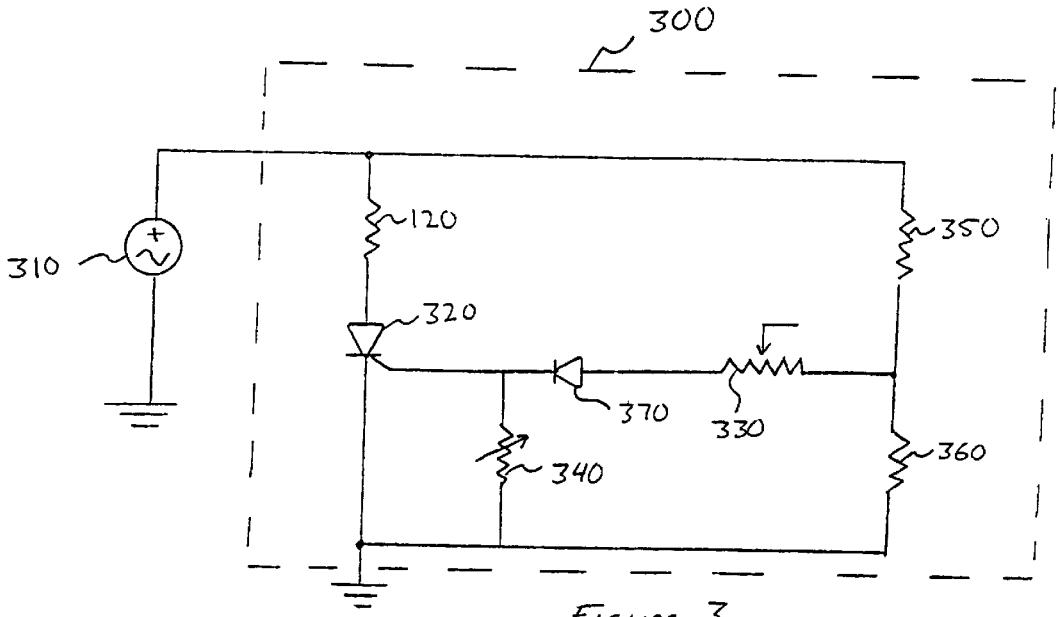
FIG. 3 is a schematic diagram of another exemplary implementation of a condensation prevention and/or removal system according to another embodiment of the present invention.

FIG. 3 is circuit schematic diagram of a condensation prevention and/or removal system according to another exemplary embodiment of the present invention. In contrast to the embodiment described with respect to FIG. 2, the circuit of FIG. 3 uses only one half of the AC cycle. Condensation prevention and/or removal system 300 includes a heating element 120, a power regulation device 320, a humidity sensor 330, a pair of fixed resistors 350, 360, a diode 370, and a potentiometer or variable resistor 340. As in the condensation prevention and/or removal system of FIG. 2, the condensation prevention and/or removal system 300 may be connected to a conventional source of power 310, such as a 120 volt or 220 volt AC power line. As in the embodiment of FIG. 2, condensation prevention and/or removal system 300 can be directly connected to the source of power 310 without the use of a transformer or specially designed power supply.

In the embodiment of FIG. 3, the power regulation device 320 is depicted as cathode gate thyristor. However, it should be appreciated that other types of power regulation devices can alternatively be used, as the present invention is not limited to a particular type of power regulation device. By using a thryistor as the power regulation device 320 instead of a triac, a lower triggering current may be used to trigger the power regulation. device than in the embodiment of FIG. 2. This, in turn, enhances the reliability of the system 300, as the humidity sensor 330 is not required to handle as large a current. Humidity sensor 330 is again a variable resistance humidity sensor in which the resistance of the humidity sensor 330 decreases with an increase in relative. humidity. As the resistance. of humidity sensor 330 decreases, the amount of current provided to the trigger of the power regulation device 320 is increased above the triggering threshold of the device 320, in a manner analogous to FIG. 2. The triggering of the power regulation device 320 permits current to flow through heating element 120, thereby increasing the temperature of the surface to which the heating element 120 is attached to prevent or dissipate condensation.

The series connection of resistors 350 and 360 form a voltage divider and are valued to coarsely set the humidity threshold set point of the condensation prevention and/or removal system 300. However, as in the embodiment of FIG. 2, the humidity threshold set point of condensation prevention and/or removal system 300 can be adjusted for different humidity environments by changing the resistance value of potentiometer 340. Because the embodiment of FIG. 3 operates only during the positive half wave cycle, the circuit of FIG. 3 uses less energy than the circuit of FIG. 2. In addition, because the heating element 120 only conducts current during the positive half wave cycle, the possibility of excessive heating of heating. element 120 is less than the embodiment of FIG. 2. Nonetheless, the power density. of the heating element 120 can be controlled in a manner similar to that described above with respect to FIG. 2 to further ensure safe operation. Alternatively, or in addition to controlling the power density of the heating element 120, an electrical fuse (not shown) may be inserted in series with the heating element 120 and the power regulation device 320 to provide fail safe operation, or a thermally activated switch (not shown) may be used instead.

It should be appreciated that the condensation prevention and/or removal system 300 of FIG. 3 automatically turns the heating element 120 on and off when the relative humidity level detected by the sensor 330 rises above or falls below a predetermined threshold of humidity in a manner similar to that described with respect to the embodiment of FIG. 2.

Figure 4:
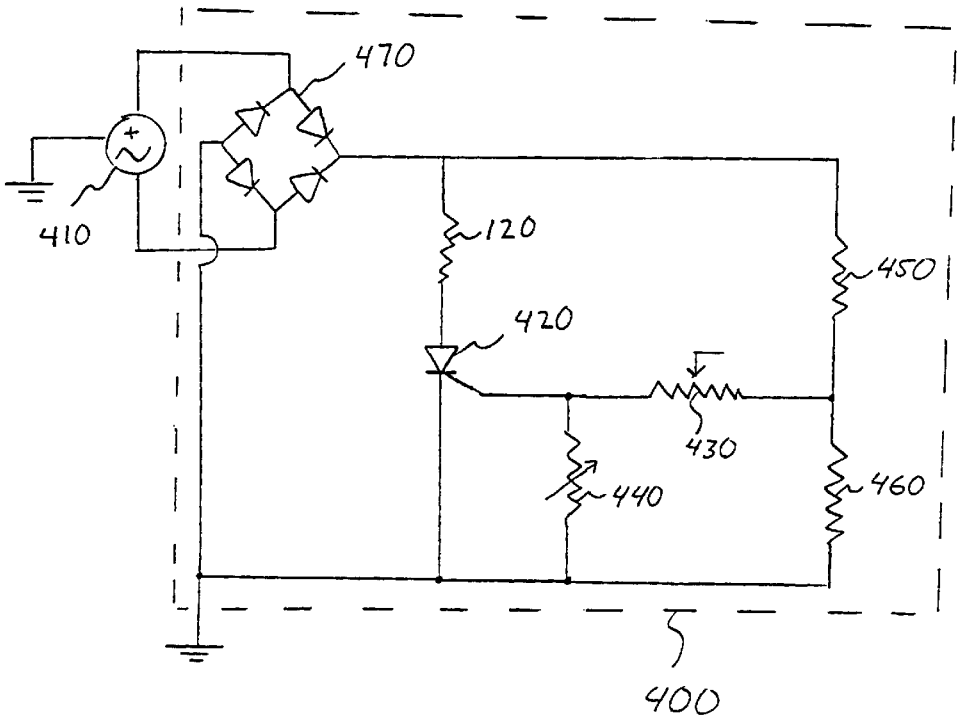
FIG. 4 is a schematic diagram of another implementation of a condensation prevention and/or removal system according to a further embodiment of the present invention.

FIG. 4 is circuit schematic diagram of a condensation prevention and/or removal system according to another exemplary embodiment of the present invention. Condensation prevention and/or removal system 400 includes a heating element 120, a power regulation device 420, a humidity sensor 430, a pair of fixed resistors 450, 460, a potentiometer or variable resistor 440, and a diode bridge rectifier 470. The embodiment of FIG. 4 operates in a manner similar to the embodiment described above with respect to FIG. 3, only condensation prevention/removal is performed over the full AC cycle. Activation of the heating element 120 over the full AC cycle permits condensation prevention and/or removal to be effected more quickly than the embodiment of FIG. 3. As in the embodiments of FIGS. 2 and 3, condensation prevention and/or removal system 400 can be directly connected to a source of AC power 410 without the use of a transformer or a specially designed power supply. As in the embodiments of FIGS. 2 and 3, the power density of the heating element 120 can be controlled to ensure safe operation, or a thermally activated switch or fuse may be used. As the operation of the condensation prevention and/or removal system 400 is similar to that described above with respect to FIG. 3, a detailed discussion of the operation of condensation prevention and/or removal system 400 is omitted herein.

Figure 5:
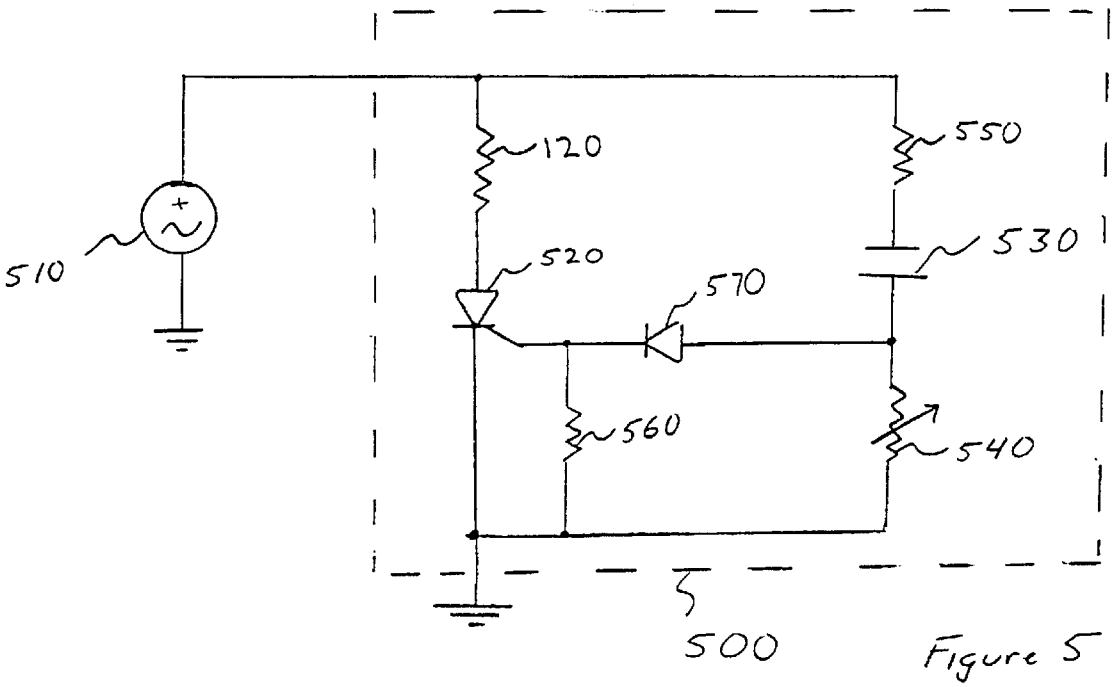
FIG. 5 is a schematic diagram of yet. another. implementation of a condensation prevention and/or removal system according to an embodiment of the present invention.

FIG. 5 is circuit schematic diagram of a condensation prevention and/or removal system according to yet another exemplary embodiment of the present invention. The condensation prevention and/or removal system 500 is substantially similar to that described above with respect to FIG. 3, in that the heating element 120, when activated, uses only one half of the AC cycle. Like the embodiment described above with respect to FIG. 3, the condensation prevention and/or removal system 500 includes a heating element 120, a power regulation device 520 in the form of a thyristor, a pair of fixed resistors 550, 560, a diode 570, a potentiometer or variable resistor 540, and a humidity sensor 530. Moreover, the condensation prevention and/or removal system 500, like the System 300 of FIG. 3, may be connected to a conventional source of power 510, such as a 120 volt or 220 volt AC power line.

However, in contrast to the embodiment Of FIG. 3, the humidity sensor 530 used in condensation prevention and/or removal system 500 is a variable capacitance humidity sensor, rather than a variable resistance humidity sensor. Specifically, the capacitance of humidity sensor 530 increases with an increase in relative humidity. As the capacitance of the humidity sensor 530 increases, the impedance of the humidity sensor 530 decreases, thereby providing a sufficient current to trigger the power regulation device 520 into conduction. The conduction of the power regulation device 520, in turn, activates the heating element 120 to prevent and/or dissipate condensation. Although variable capacitance humidity sensors are generally more variable in terms of capacitance from one sensor to another, their small size and low cost, in comparison to a variable resistance humidity sensor, makes them attractive for applications in which size and cost are important design parameters. As in the embodiment of FIG. 3, potentiometer 540 permits the humidity threshold set point. to be adjusted to suit a particular environment or the preferences of a particular user. In particular, by increasing the resistance of potentiometer 540, the humidity threshold set point is decreased, and by decreasing the resistance of potentiometer 540, the humidity threshold set point is increased.

Figure 6:
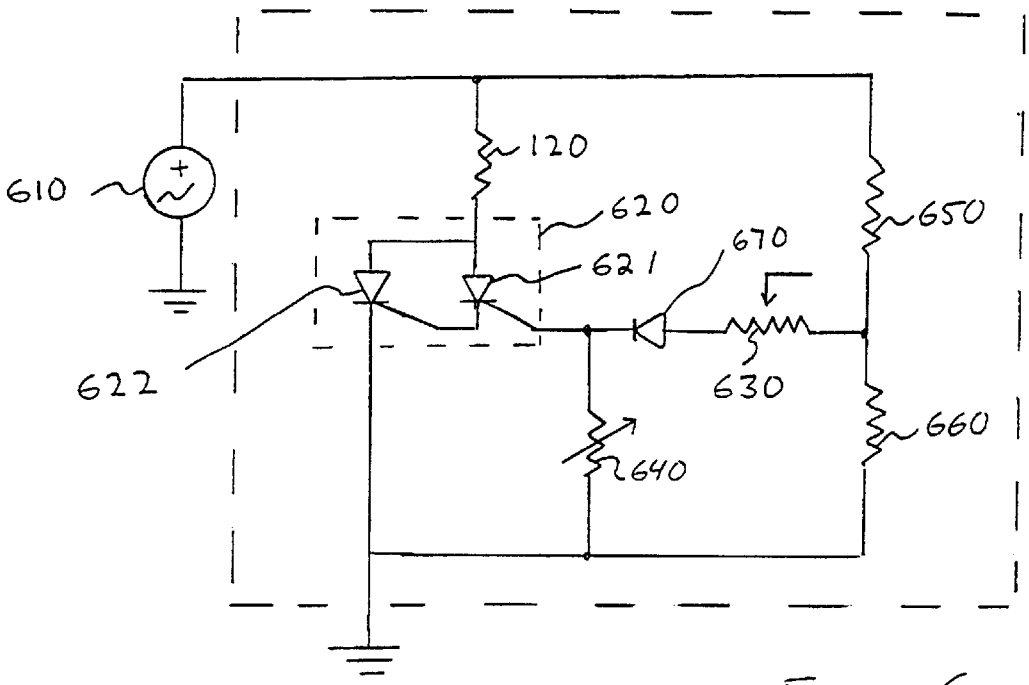
FIG. 6 is a schematic diagram of another implementation of a condensation prevention and/or removal system according to an embodiment of the present invention.

FIG. 6 is a circuit schematic diagram of a condensation prevention and/or removal system according to a further embodiment of the present invention. The condensation prevention and/or removal system 600 is again substantially similar to the system 300 described above with respect to FIG. 3, in that the heating element 120, when activated, uses only one half of the AC cycle. The condensation prevention and/or removal system 600, like the system 300 of FIG. 3, may be connected to a conventional source of power 610, such as a 120 volt or 220 volt AC power line. Furthermore, condensation prevention and/or removal system 600 also includes a heating element 120, a power regulation device 620, a pair of fixed resistors 650, 660, a diode 670, a potentiometer or variable resistor 640, and a variable resistance humidity sensor 630, like the embodiment of FIG. 3. However, in contrast to the embodiment of FIG. 3. the power regulation device 620 of the condensation prevention and/or removal system 600 includes two distinct power regulation devices 621 and 622. Power regulation device 621 is a cathode gate thyristor with a sensitive (i.e., low triggering current) gate, while power regulation device 622 is a high power cathode gate thyristor or other high power triggerable device that can conduct large values of current without destruction. The embodiment of FIG. 6 is particularly well suited for preventing or removing condensation from larger surface that utilize larger heating elements, for example to prevent and/or remove condensation on surface that is a square foot or more (0.09 square meters) in area. The embodiment of FIG. 6 may also be used with multiple heating elements, for example, a first heating element to provide a clear viewing area, and a second heating element to display a logo, etc. Advantageously, the embodiment of FIG. 6 permits larger heating elements to be used while avoiding the conduction of large triggering currents through the variable resistance humidity sensor 630, which can impact reliability.

As described above, the condensation prevention and/or removal systems of embodiments of the present invention provide automatic condensation prevention and/or removal whenever the relative humidity detected by the humidity sensor rises above a predetermined threshold. Each of the described embodiments also automatically turn off when the relative humidity falls below the predetermined threshold. For this reason, embodiments of the present invention cannot accidentally be left in the on condition.

It should be appreciated that a number of alterations made be made to any of the above described embodiments of FIGS. 1–6 that are considered to be within the spirit and scope of the present invention. For example, in each of the embodiments of FIGS. 2–6, a visual indicator may be connected in parallel with the heating element 120, to provide a visual indication of heating element operation. Such a visual indicator provides the user with positive feedback that the condensation prevention and/or removal system is operational. It also provides feedback that allows the user to adjust the relative humidity level at which the heating element 120 of the condensation prevention and/or removal system turns on and off. Further, the embodiments described with respect to FIGS. 1–4 and 6 may be modified to utilize a variable capacitance humidity sensor, rather than a variable resistance humidity sensor, and each of the embodiments described with respect to FIGS. 2–5 may be adapted to utilize a power regulation device, such as that described with respect to FIG. 6.

It should be appreciated that embodiments of the present invention provide an inexpensive and reliable mirror defogging system that uses few components and can be directly connected to standard home wiring in new or existing construction. Moreover, embodiments of the present invention consume a relatively small amount of power in a standby mode (i.e., when the relative humidity is below a level capable of triggering the power regulation device), approximately 0.2W at 120V.

Having described several embodiments of the invention in detail, various modifications and improvements will readily occur to those skilled in the art. Such modifications and improvements are intended to be within the spirit and scope of the invention. Accordingly, the foregoing. description is by way of example only, and is not intended as limiting. The invention is limited only as defined by the following claims and the equivalents thereto.

What is claimed is:

1. A condensation control system, comprising:

a first terminal adapted to be directly connected to an AC power source and a second terminal;

a heating element electrically coupled in series with a power regulation device between the first and second terminals, the power regulation device having a trigger;

a voltage divider electrically coupled in series between the first and second terminals and in parallel with the heating element and the power regulation device, the voltage divider having an output; and a humidity sensor, electrically coupled between the output of the voltage divider and the trigger of the power regulation device, that senses an amount of humidity and triggers the power regulation device to activate the heating element when the amount of humidity sensed by the humidity sensor is greater than a predetermined humidity threshold set point.

2. The condensation control system of claim 1, further comprising:

a variable resistor to adjust the predetermined humidity threshold set point, the variable resistor having a first terminal that is electrically coupled to the humidity sensor and the trigger of the power regulation device and a second terminal that is electrically coupled to the second terminal of the condensation control system.

3. The condensation control system of claim 1, wherein the humidity sensor is a variable resistance humidity sensor.

4. The condensation control system of claim 1, further comprising:

a diode, having a first terminal that is electrically coupled to the humidity sensor and a second terminal that is electrically coupled to the trigger of the power regulation device, that limits activation of the heating element to one half of an AC cycle.

5. The condensation control system of claim 1, wherein the power regulation device includes a cathode gate thyristor having an anode that is electrically coupled to the heating element, a cathode that is electrically coupled to the second terminal of the condensation control system, and a gate that is electrically coupled to. the humidity sensor.

6. The condensation control system of claim 1, wherein the power regulation device includes:

a first cathode gate thyristor having an anode, a cathode, and a gate; and a second cathode gate thyristor having an anode, a cathode, and a gate;

wherein the anodes of the first and second cathode gate thyristor are electrically coupled to the heating element, the cathode of the first cathode gate thyristor is electrically coupled to the gate of the second cathode gate thyristor, the cathode of the second cathode gate thyristor is electrically coupled to the second terminal of the condensation control system, and the gate of the first cathode gate thyristor is electrically coupled to the humidity sensor.

7. The condensation control system of claim 6, wherein the first cathode gate thyristor has a low triggering current gate and the second cathode gate thyristor is a high power thyristor.

8. The condensation control system of claim 1, wherein the power regulation device is a triac.

9. The condensation control system of claim 1, wherein the heating element has a power density that is lower than approximately 35 W/ft$^2$ (389 W/ m$^2$).

10. The condensation control system of claim 1, further comprising:

a bridge rectifier that directly connects the first terminal of the condensation control system to the AC power source.

11. The condensation control system of claim 1, wherein the heating element is disposed on a surface in a shape of an alphabetic letter, a numeral, a word, or a company identifier.

12. The condensation control system of claim 1, wherein the humidity sensor prevents activation of the heating element when the amount of humidity sensed by the heating element when the amount of humidity sensed by the humidity sensor is less than the predetermined humidity threshold set point.

13. A condensation control system, comprising:

a first terminal adapted to be directly connected to an AC power source and a second terminal;

a heating element electrically coupled in series with a power regulation device between the first and second terminals, the power regulation device having a trigger;

a first resistor and a second resistor electrically coupled in series between the first and second terminals and in parallel with the heating element and the power regulation device;

third resistor electrically coupled between the trigger of the power regulation device and the second terminal; and a humidity sensor electrically coupled in series between the first resistor and the'second resistor, the humidity sensor having a first terminal that is electrically coupled to the first resistor and a second terminal that is electrically coupled to the second resistor and the trigger of the power regulation device, the humidity sensor sensing an amount of humidity and triggering the power regulation device to activate the heating element when the amount of humidity sensed by the humidity sensor is greater than a predetermined humidity threshold set point.

14. The condensation control system of claim 13, wherein the humidity sensor is a variable capacitance humidity sensor.

15. The condensation control system of claim 13, wherein the second resistor is a variable resistor having a resistance that can be varied to adjust the predetermined humidity threshold set point.

16. The condensation control system of claim 13, further comprising:

a diode, having a first terminal that is electrically coupled to the humidity sensor and a second terminal that is electrically coupled to the trigger of the power regulation device, that limits activation of the heating element to one half of an AC cycle.

17. The condensation control system of claim 13, wherein the power regulation device includes a cathode gate thyristor having an anode that is electrically coupled to the heating element, a cathode that is electrically coupled to the second terminal of the condensation control system, and a gate that is electrically coupled to the humidity sensor.

18. The condensation control system of claim 13, wherein the power regulation device includes:

a first cathode gate thyristor having an anode, a cathode, and a gate; and a second cathode gate thyristor having an anode, a cathode, and a gate;

wherein the anodes of the first and second cathode gate thyristor are electrically coupled to the heating element, the cathode of the first cathode gate thyristor is electrically coupled to the gate of the second cathode gate thyristor, the cathode of the second cathode gate thyristor is electrically coupled to the second terminal of the condensation control system, and the gate of the first cathode gate thyristor is electrically coupled to the humidity sensor.

19. The condensation control system of claim 18, wherein the first cathode gate thyristor has a low triggering current gate and the second cathode gate thyristor is a high power thyristor.

20. The condensation control system of claim 13, wherein the heating element has a power density that is lower than approximately 35 W/ft$^2$ (389 W/m$^2$).

* * * * *